US009512621B1

(12) United States Patent
Trezza

(10) Patent No.: US 9,512,621 B1
(45) Date of Patent: Dec. 6, 2016

(54) STRUCTURE CONNECTION SYSTEM

(71) Applicant: Ronald Trezza, Melville, NY (US)

(72) Inventor: Ronald Trezza, Melville, NY (US)

( * ) Notice: Subject to any disclaimer, the term of this patent is extended or adjusted under 35 U.S.C. 154(b) by 0 days.

(21) Appl. No.: 14/791,171

(22) Filed: Jul. 2, 2015

(51) Int. Cl.
*E04F 13/08* (2006.01)
*E04B 2/56* (2006.01)
*E04F 13/14* (2006.01)

(52) U.S. Cl.
CPC ..... *E04F 13/0803* (2013.01); *E04B 2/56* (2013.01); *E04F 13/0875* (2013.01); *E04F 13/142* (2013.01); *E04B 2002/565* (2013.01)

(58) Field of Classification Search
CPC .. E04F 13/0803; E04F 13/0875; E04F 13/132; E04B 2/56; E04B 2002/565
USPC ..... 52/302.1, 474, 476, 477, 479, 483.1, 762,52/384, 386, 309.7
See application file for complete search history.

(56) References Cited

U.S. PATENT DOCUMENTS 800,655 A * 10/1905 Kitsee ..... E04F 13/0803 264/261
830,313 A * 9/1906 Penn ..... E04F 13/0803 52/386
874,909 A * 12/1907 Fischer et al. ..... E04F 13/0803 52/386
1,850,961 A * 3/1932 Mortenson ..... E04F 13/0801 52/387
1,861,359 A * 5/1932 Pyron ..... E04F 13/14 52/387
1,946,690 A * 2/1934 Haines ..... E04F 13/0801 52/386
1,994,644 A * 3/1935 Harshberger ..... B28B 23/0012 52/311.1
2,005,380 A * 6/1935 Marsh ..... E04F 13/12 52/392

(Continued)

OTHER PUBLICATIONS

Code Compliant Continuously Insulated Exterior Wall Assembly by Knight Wall Systems dated Jun. 19, 2013.

*Primary Examiner* — Joshua J Michener
*Assistant Examiner* — Alp Akbasli
(74) *Attorney, Agent, or Firm* — Harold G. Furlow, Esq.

(57) ABSTRACT

A structure connection system is described that connects an exterior façade to an exterior framing. The structure connection system comprises a first section and a second section. The first section includes exterior sheathing, insulation sheathing and a plurality of batten plates. The exterior sheathing is adapted to connect to an exterior framing of an existing structure. The insulation sheathing is a thermal rigid insulation board sheathing. Each batten plate of the plurality of batten plates is a right angle elongate plate. Each batten plate has a first flat elongate leg and a second flat elongate leg. The second leg is inserted into the insulation sheathing and the first leg is positioned against the front planar surface of the insulation sheathing. Each batten plate of the plurality of batten plates is located in fixed spaced separation from the adjacent batten plate. A plurality of fasteners connect the first section into an integrated assembly. The fasteners connect to the batten plates and the first section adapted to connect to the exterior framing. The fasteners place the first section under compression and connect the first section in position on the exterior framing 3 as a cantilevered structure. An external façade is connected to the first section that provides a weatherproof external barrier.

20 Claims, 7 Drawing Sheets

(56) References Cited

U.S. PATENT DOCUMENTS 2,043,706 A * 6/1936 Myers ..... E04F 13/0803 52/387
2,054,573 A * 9/1936 Mendenhall ..... E04F 13/0803 52/385
2,078,069 A * 4/1937 Eliel ..... E04B 2/00 52/169.1
2,114,451 A * 4/1938 Mattes ..... E04F 13/147 264/DIG. 57
2,202,568 A * 5/1940 Worden ..... E04F 13/0801 52/385
2,243,339 A * 5/1941 Henzel ..... F27D 1/004 52/405.3
2,870,624 A * 1/1959 Sampson ..... F27D 1/004 110/331
3,270,473 A * 9/1966 Smith ..... E04F 13/18 428/49
3,353,315 A * 11/1967 Barker ..... E04C 2/22 428/167
3,387,422 A * 6/1968 Wanzer ..... E04B 5/40 52/387
3,533,206 A * 10/1970 Passeno, Jr. ..... E04F 13/08 156/71
3,740,911 A * 6/1973 O'Leary ..... E04F 13/0862 52/388
3,868,801 A * 3/1975 Weiner ..... E04C 2/041 264/261
3,962,504 A * 6/1976 Sherwin ..... E04F 13/142 428/167
4,333,290 A 6/1982 Koberstein
4,589,241 A * 5/1986 Volpenhein ..... E04F 13/147 52/315
4,619,090 A * 10/1986 McManus ..... E04B 2/92 52/235
4,662,140 A * 5/1987 Porter ..... E04F 13/0885 52/385
4,741,137 A 5/1988 Barratt
4,956,949 A 9/1990 Francis
5,113,631 A * 5/1992 diGirolamo ..... E04B 1/24 52/236.8
5,226,273 A * 7/1993 Burke ..... E01C 5/223 52/315
5,313,753 A * 5/1994 Sanger ..... E04B 7/22 52/251
5,367,847 A * 11/1994 Hepler ..... E04C 2/296 428/319.9
5,381,635 A * 1/1995 Sanger ..... E04B 7/22 52/251
5,566,517 A 10/1996 Ishii et al.
5,660,907 A * 8/1997 Skalka ..... B29B 17/0042 428/105
5,667,190 A * 9/1997 Scott ..... B28B 19/0061 249/16
5,715,637 A * 2/1998 Hesterman ..... E04B 1/942 52/309.8
5,799,462 A 9/1998 McKinney
5,865,001 A * 2/1999 Martin ..... E04B 1/04 52/284
5,953,883 A 9/1999 Ojala
6,003,278 A * 12/1999 Weaver ..... E04C 2/382 249/26
6,058,672 A * 5/2000 McClellan ..... E04B 1/04 52/309.12
6,138,423 A * 10/2000 Poutanen ..... E04F 13/0803 52/311.2
6,186,469 B1 * 2/2001 Scott ..... B28B 19/0061 249/16
6,240,691 B1 6/2001 Holzkaemper et al.
6,421,972 B1 7/2002 Dalphond et al.
6,725,616 B1 4/2004 Pease
6,786,015 B2 * 9/2004 Wilt ..... E04D 13/158 52/233
6,857,237 B1 2/2005 Dalphond et al.
6,892,507 B1 5/2005 Pease
6,951,086 B2 10/2005 Passeno
7,424,789 B2 * 9/2008 Zhou ..... F24B 1/198 126/500
7,493,732 B2 * 2/2009 Brailsford ..... B28B 23/0075 52/311.1
7,617,646 B2 * 11/2009 Losse ..... E04F 13/14 52/385
7,743,569 B1 * 6/2010 Schwalenberg ..... E04F 13/142 52/288.1
8,141,310 B2 3/2012 Trezza
8,429,866 B2 4/2013 Knight et al.
8,555,583 B2 * 10/2013 Ciuperca ..... B23P 11/00 52/309.11
8,572,918 B1 * 11/2013 Zhou ..... E04B 1/762 52/407.4
8,820,016 B2 * 9/2014 Zhou ..... E04B 1/762 52/404.2
8,833,023 B2 9/2014 Masure et al.
8,925,269 B1 1/2015 Beaudin
8,962,088 B2 * 2/2015 Shaw ..... E04B 2/845 264/293
8,966,845 B1 * 3/2015 Ciuperca ..... E04B 1/80 52/309.12
2010/0058700 A1 * 3/2010 LeBlang ..... E04B 1/165 52/506.05
2011/0197537 A1 * 8/2011 Oberg ..... E04D 3/3603 52/650.1

* cited by examiner

STRUCTURE CONNECTION SYSTEM

BACKGROUND OF THE INVENTION

1. Field of the Invention

This disclosure relates to structures for buildings and in particular to methods for and apparatuses of layered structural components that connect to the exterior framing of a structure, the layered structural components provide insulation, drainage and support load bearing external façades.

2. Description of the Related Art

The connection of external facades to the external framing of a structure has been done by various methods to include the use of adhesives, nails and screws. The advent of polystyrene sheets necessitated new methods of connecting the relatively thick and light foam insulation to external framing because traditional nails, screws and adhesive fasteners do not provide a long term reliable connection of the foam insulation layer to the exterior framing. In particular, the effectiveness of insulation requires the continuity of the insulation and a firm continuous connection of the insulation to the exterior framing to properly insulate the structure. Innovations to address this problem included U-shaped channels that embed into the polystyrene insulation. The structure of the channels can vary, but they typically include a central plate with a pair of opposing flanges that extend from the central plate at an approximately ninety (90) degree angle. The junction between the flanges and central plate can further include structural enhancements such as corner beads. The depth in which the flanges of the channels embed into the insulation can vary greatly. Some channels are constructed to provide a stand-off or are alternatively employed with additional structural elements to define a stand-off from the insulation that defines a gap or dead space between layers of construction or a continuous series of layers. The U-shaped channels are typically nailed or screwed into the studs of the exterior framing.

Current construction specifications and building codes can require multiple layers to be connected together for insulation, fireproofing, moisture drainage and moisture resistance. These layers have varying thicknesses and structural attributes. Many external facades are relatively light weight such as vinyl siding and can be readily attached the exterior framing, but many external façades such as thin brick and tile require enhanced structural systems for the loads associated with their external façade. As a result, many systems for the connection of multiple layers of construction do not provide the required support for thin brick and tile external facades. Other systems for connecting the multiple layers have undesirable characteristics such as extending the multiple layers further away from the exterior framing and thereby distancing the load of the thin brick and tile an excessive distance from the exterior framing. Finally, there is often a credibility gap between the actual structure and the specified structure because of construction method short cuts and care made in the connectivity of the multiple layers. This results in nails and screws not being correctly connected to the external framing, but simply to the external sheathing. Nails and screws connecting to the external sheathing not provide long term reliable nail or screw connections that are demanded in modern highly insulative structures.

A structure connection system is needed that can support specification and building code requirements and provide support for a wide array of external facades. Heretofore, there has never been a compact system and method for rapidly connecting external layers to an external framing. The present disclosure provides a high quality connection system and method to readily assemble multiple layers, place the multiple layers under compression to provide structural support and retain the desired functions of the insulation, barrier, drainage mat and external façade components.

The structure connection system has flexibility in its application, but provides structural support for any type of external façade to include thin brick and tile under severe weather conditions. The structure connection system includes an array of separate backing plates that are connected to the exterior framing and extend in approximately horizontal rows perpendicular to the vertical studs. The backing plates overcome the need for an exact alignment of the nails and/or screws with the studs of the exterior framing and thereby aid in the rapid construction of a quality structure. Multiple layers are connected between a batten plate and the backing plate and placed in compression to provide a high integrity structure. The external façade of thin brick and tile is then connected to the batten plate.

SUMMARY OF THE INVENTION

A structure connection system for connecting an exterior façade to an exterior framing is described that comprises a first section and a second section. The first section preferably includes an exterior sheathing, a moisture resistant barrier, an insulation sheathing and a plurality of batten plates. The second section includes an external façade.

The exterior sheathing of the first section is a rigid flat panel that is adapted to be positioned against the exterior framing. The insulation sheathing is a thermal rigid insulation board sheathing that has a front approximately planar surface and a back approximately planar surface. Each batten plate of the plurality of batten plates is a right angle elongate plate. The right angle has a first elongate leg and a second elongate leg. The batten plate defines an elongate axis. The first leg of the batten plate has a first width normal to the elongate axis defined by the batten plate and the second leg has a second width normal to the elongate axis defined by the batten plate. The width of the first leg is equal to or greater than the width of the second leg. The second leg is inserted into the insulation sheathing and the first leg is positioned against the front planar surface of the insulation sheathing. Each batten plate of the plurality of batten plates is located in fixed spaced separation from the adjacent batten plate. A plurality of first fasteners connect the first section into an integrated assembly. The first fasteners connect to the batten plates and are adapted to connect the first section to the exterior framing. The first fasteners place the first section under compression.

The second section includes an external façade and a plurality of second fasteners. The plurality of second fasteners connect the external façade to the plurality of batten plates. The assembled first section and second section are connected to the external framing as a cantilever structure.

DETAILED DESCRIPTION OF THE INVENTION

Figure 1:
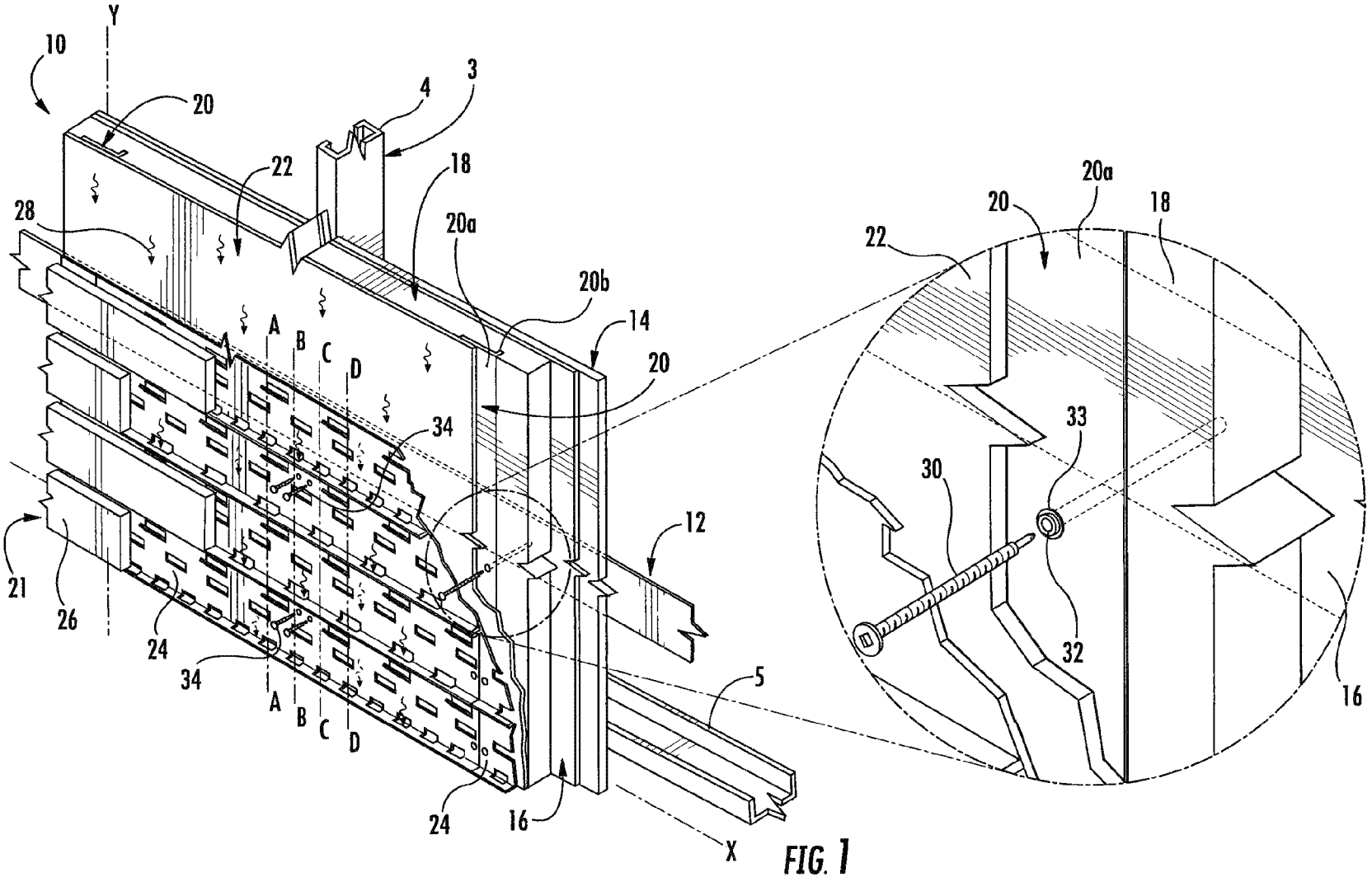
FIG. 1 is a front, side and top perspective view of a structure connection system with a staggered cross-sectional view constructed in accordance with the present disclosure, the structure connection system includes an external facade and the structure connection system connected to an exterior sheathing of an existing structure.

Referring initially to FIG. 1, a structure connection system 10 is a multiple layer structure that includes an external façade for a structure such as thin brick and tile. Structure connection system 10 preferably connects to an existing exterior framing of an external structure and supports the external façade. Structure connection system 10 uses an enhanced layered approach to construction that is easily installed and readily accommodates variations and changes during the construction process. Structure connection system 10 includes a first section that insulates, resists moisture penetration and provides structural support for a second section. The first section connects to an exterior framing 3. It is understood that exterior framing 3 as defined herein includes wall studs 4 of the exterior framing as well as other types and portions of the exterior framing 3 such as the track and/or base plate 5, for example. The first section provides a thermal insulation barrier and as desired at least a vapor resistant barrier. The second section includes a drainage mat and an external façade.

The first section includes an arrangement of backing plates 12, exterior sheathing 14, a moisture resistant barrier 16 and insulation sheathing 18 and batten plates 20. A second section includes a drainage mat 22, a metal grid panel 24 and an outer surface covering 26. The first section connects to exterior framing 3 of exterior framing 3. The second section connects to the first section.

Backing plates 12 are preferably sheet metal strips or plates. Backing plates 12 are flat elongate plates. Backing plates 12 have a first side, a second side opposed to the first side, a third side and a fourth side opposed to the second side. The first side and second side of backing plates 12 preferably have a width that is approximately three (3) to six (6) inches. The third side and fourth side preferably have a thickness between approximately one sixteenth (1/16) and approximately three thirty-second (3/32) of an inch. The second sides of backing plates 12 interface with and connect to exterior framing 3. Backing plates 12 preferably extend approximately horizontal along external framing 3. The spacing and dimensions of backing plates 12 on external framing 3 can vary depending upon a desired application of structure connection system 10, but are preferably spaced at standard on-center vertical distance spacing such as for example approximately twelve (12), approximately sixteen (16) or approximately twenty-four (24) inches.

Backing plate 12 is preferably a thin flat galvanized sheet metal plate, but backing plate 12 can be fabricated of any suitable structural material to include structural composite materials. Backing plate 12 is preferably an elongate sheet metal strip that minimizes the horizontal depth of structure connection system 10 while providing adequate structural connectivity to exterior framing 3. The application of backing plates 12 to exterior framing 3 can also depend upon factors such as the dimensions of backing plates 12 and local building codes.

Backing plates 12 provide a structural connection across exterior framing 3 that advantageously expedites the assembly of the remaining layers of the first section of structure connection system 10. Backing plates 12 overcome the need for an exact alignment of the connection between the first section of structure connection system 10 and the relatively narrow width of standard sized studs 4 such as the approximate one and a half (1.5) inch actual side edge width of the standard two by four (2×4) or two by six (2×6) inch wood or metal stud 4 of exterior framing 3.

Exterior wall sheathing 14 connects directly to the front of backing plate 12 and/or exterior framing 3. Exterior wall sheathing or exterior sheathing 14 preferably provides both a structural and an insulative barrier. Exterior sheathing 14 can be any type of material for wall structural sheathing applications to include wood sheathing products such as plywood and oriented strand board, fiberboard (which as defined herein can include wood and/or non-cellulose fibers that can include other plant materials or recycled fibers) and masonry board.

In the preferred embodiment, exterior sheathing 14 is exterior grade wallboard sheathing. Depending upon the individual application of structure connection system 10, the material of exterior wall sheathing 14 has to be in compliance with local building codes to include, for example, water resistivity, water absorption, strength, structural stability, fire proof ratings and mold resistance for residential, industrial or commercial buildings. Exterior wall sheathing 14 is available in standard sizes such as, but not limited to four by eight (4×8) foot sheets. Standard thicknesses for exterior sheathing 14 include one-half (1/2) and five-eighths (5/8) inches, but it is understood that the thickness and overall height and width dimensions can vary depending upon factors such as building codes and a given application of structure connection system 10.

Moisture resistant barrier 16 is connected directly to exterior wall sheathing 14 and is preferably a combined air and moisture barrier. Moisture resistant barrier 16 provides enhanced drainage when subjected to extreme levels of wind and driving rains. Moisture resistant barrier 16 is preferably vapor permeable, but can be a low permeance barrier or vapor barrier depending upon the climatic conditions and internal environmental requirements. Types of moisture resistant, barrier 16 include building paper such as asphalt coated traditional paper or felt and polymeric-based barriers such as housewrap plastic sheet wrappings, moisture resistant barrier insulative sheathing and liquid applied building wrap. Moisture resistant barrier 16 can come in various forms as previously noted to include sheets of various sizes, rolls and as a liquid that can be applied by brush or spray. Depending upon the type and quality of exterior sheathing 14 as well as other factors, moisture resistant barrier can be optional in structure connection system 10.

Insulation 18 is a rigid insulation board sheathing that can vary in thickness depending upon the desired application. Insulation 18 has standard industry thicknesses that can vary from less than one (1) inch to four (4) or more inches. In the preferred embodiment, insulation 18 is closed cell, moisture-resistant rigid extruded polystyrene foam, board that is suitable for residential or commercial applications. Insulation 18 as a rigid board is also suitable for compressive load applications such as those applied by structure connection system 10. Insulation 18 can come in sheets of various sizes such as, but not limited to 4×8 foot sheets.

Each batten plate 20 is an elongate right angle plate. Batten plate 20 includes a first leg 20*a* and a second leg 20*b* that are connected along one of their respective elongate edges to define an elongate approximately ninety-degree (90°) angle. A longitudinal axis is defined by elongate batten plate 10. First leg 20*a* is preferably plate or flat shaped with a first width perpendicular to the elongate axis between second leg 20*b* and a free edge and the second leg 20*b* is preferably plate or flat shaped and has a second width perpendicular to the elongate axis between first leg 20*a* and a free edge. The first leg 20*a* defines a plurality of apertures that extend approximately through and approximately normal to the plane defined by first leg 20*a*. In the preferred embodiment, batten plate 20 first leg 20*a* has a width approximately between one and three-quarters (1¾) inch and approximately two (2) inches and second leg 20*b* has a width between approximately one-quarter (¼) and five-sixteenth (5⁄16) inch.

Batten plates 20 typically come in standard lengths such as four (4) or eight (8) foot lengths that can correspond to the dimensions of insulation 18. It is understood, that batten plates 20 can be fabricated in any dimensions, but are preferably flat elongate plates with a minimal second leg 20*b* width.

Batten plate 20 can be fabricated by any means to include, but not limited to formed, welded or cast. In the preferred embodiment, batten plate 20 is a fabricated of galvanized steel, but it is understood that batten plate 20 could be made of wide variety of materials to include other metals/metal alloys as well as low conductivity materials such as cellulose and composite materials to include ceramics and/or polymers. Batten plate 20 can also include one or more layers or coatings of low conductivity materials.

The second section includes a drainage mat 22 and external façade 21. In this preferred embodiment, external façade 21 includes a metal grid panel 24 and thin brick, stone or tile 26, but it is understood that other alternative external facades 21 such as, but not limited to siding, stucco and panels can be employed with structure connection system 10.

Drainage mat 22 connects directly to insulation 18 and/or batten plate 20. Drainage mat 22 can be positioned over and/or connect to batten plate 20. Drainage mat 22 can have a range of porous structures that accommodate the drainage liquids and the flow of air or a solid insulation barrier with surface channels for the downward flow of fluids. The drainage of liquids in drainage mat 22 is assisted by capillary action. Drainage mat 22 can vary from drainage paper that has a minimal thickness to thicker mat type structures with an exterior face that defines channels or pathways for water drainage. Drainage mat 22 has a structural integrity that preserves the pathways for fluid flow under compression. In addition, drainage mat 22 can be one or more layers and preferably does not absorb moisture, is not a food source for mold and has thermal resistance qualities.

Grid panel 24 is positioned directly against drainage mat 22. Grid panel 24 is a sheet with a front 18*a* that faces in an exterior direction and a back 20*a* (See FIG. 3) that faces in an internal direction towards exterior framing 3. Back 20*a* is in direct contact with drainage mat 22 and bricks 26 are connected to grid panel 24. In this idealized representation, fluid in the form of idealized liquid drops 28 flow down front 18*a* of grid panel 24, pass through grid panel 24 to the back side of grid panel 24, collect at the bottom of the exterior framing 3 and are directed to a drain away from the exterior framing 3.

Grid panels 24 can vary in their dimensions and thickness of their construction. Grid panels 24 preferably have a rectangular conformation that is suitable for being connected together to form an array of grid panels 24, but can be fabricated to any dimensions for a particular construction. For example, standard grid panel 24 dimensions include between approximately forty-eight (48) and approximately ninety-six (96) inches by between approximately eight (8) inches and approximately twenty-four (24) inches by approximately eight (8) inches and approximately twenty-four (24). Grid panels 24 are preferably fabricated of rust resistant sheet metal, but grid panels 24 can be made of a variety of materials to include polymers, polymer composites and ceramics as well as metals. The dimensions of grid panel 24 can vary to accommodate the dimensions of the different sizes and shapes of materials of bricks 26.

Bricks 26 are commonly known as thin brick and tile, but can be natural materials such as stone or man-made materials that include man-made simulated stone as well as tile. Further, the height length dimensions of bricks 26 can vary. Bricks 26 are typically initially connected to grid panel 24 using an adhesive and the mortar is applied between bricks 26 to secure bricks 26 in position and provide a weatherproof, long-lasting external façade with an enduring visual appeal.

Structure connection system 10 is connected together as individual components and/or layers. Horizontal backing plates 12 are fastened to exterior framing 3 in fixed spaced separation in preferably horizontal rows. The distance between rows is preferably sixteen (16) or twenty-four (24) inches on center, but this can vary depending upon the intended application. The layers of exterior sheathing 14, moisture resistant barrier 16 and insulation 18 are temporarily connected in sequence to backing plates 12 using standard methods in the industry that can include bolts, nails and glue. It is understood that individual layers such as exterior sheathing, moisture resistant barrier 16 and insulation 18 can be prefabricated or replaced by materials that combine two or more of their functions in structure connection system 10.

A plurality of batten plates 20 are preferably connected to insulation sheathing 18 in an approximately parallel alignment at fixed spaced intervals. Batten plates 20 connect to insulation sheathing 18 and secure the first section to backing plates 12 as a cantilevered structure. Insulation sheathing 18 can define cuts or slots with a predefined depth and vertical separation that are configured to receive second leg 20*b* of batten plate 20. In the preferred embodiment, the free edge of second leg 20*b* is embedded in and has a friction connection with insulation 18.

Insulation 18 can further include a shallow cut configured to receive and/or align first leg 20*a* of batten plate 20 such that the outwardly facing side of first leg 20*a* is approximately aligned or flush with the outwardly facing planar surface of insulation 18. The cut for batten plate 20 can be made during the fabrication process or at the construction site. Similarly, the nature of insulation 18 as a rigid board material is such that the second leg 20*b* and first leg 20*a* can be manually pressed into insulation 18 and be approximately aligned with the outwardly facing planar surface of insulation 18. For example, the free edge of second leg 20*b* can be shaped with as an edge that facilitates the penetration of second leg 20*b* into insulation 18.

The first section is connected to backing plate 12 by first fasteners 30 that are positioned through batten plates 20, insulation 18, moisture resistant barrier 16, exterior sheathing 14 and backing plates 12. The first legs 20*a* of batten plates 20 preferably define a plurality of apertures 32 at predetermined locations along the elongate length of leg 20*a*. The location of each aperture 32 of the plurality of apertures 32 correlates with the spacing intervals for backing plates 12 for a particular structural application. First fasteners 30 are preferably screws that are received by apertures 32 of batten plates 20 and have sufficient length and hardness to penetrate through insulation 18, moisture resistant barrier 16, exterior sheathing 14, backing plate 12 and exterior sheathing 3. First fasteners 30 connect to batten plate 20 and place the first section in compression between batten plates 20 and backing plates 12. First fasteners 30 are preferably continuously threaded along their shank and suitable for power tool installation, cutting through and connection to backing plates 12. While batten plates 20 preferably include a plurality of apertures 32, the tip of first fastener or fastener 30 can also be used to cut through batten plates 20, backing plate 12 and exterior framing 3.

The resistance to thermal conductivity of the first section is enhanced by the arrangement of the different layers of the first section and the relative thermal isolation of fasteners 30 that connect the first section to exterior framing 3 through apertures 32 in backing plate 12. The plurality of apertures 32 in batten plates 20 preferably include thermal isolation inserts 33 that are positioned in apertures 32 and can extend along first leg 20*a*. Inserts 33 to provide a physical insulative barrier between batten plate 20 and fastener 30. The physical insulative barrier between batten plate 20 and fastener 30 is thermal break that resists the undesirable transfer of heat or cold within structure connection system 10. Inserts 33 as defined herein extended sleeves to provide additional thermal isolation.

Batten plates 20 are approximately vertically aligned and located at horizontal intervals along backing plates 12. Batten plates 20 preferably connect to backing plates 12 at approximately twelve (12) inch, sixteen (16) inch or approximately twenty-four (24) inch intervals depending upon factors such as the on-center distance between the studs 4 of exterior framing 3. Batten plates 20 can be connected to backing plates 12 and/or exterior framing 3 at any location relative to studs 4 to include in approximate alignment with studs 4 or at any other location on backing plates 12 relative to studs 4. The intervals or spacing between batten plates 20 can vary depending upon the desired application of structure connection system 10.

Backing plates 12 provide a structural element across exterior framing 3 that advantageously provides for an expedited the rapid assembly of structure connection system 10. Backing plates 12 overcome the need for an exact alignment of the connection between the first section of structure connection system 10 and the relatively narrow one and a half (1.5) inch width of the side edge of the standard metal or wood two (2) by four (4) inch stud 4 or other structural elements of exterior framing 3. Further, while studs 4 of exterior framing 3 are typically spaced in standard twelve (12) sixteen (16) or twenty-four (24) inches on center, in many instances the actual fixed spaced separation of studs 4 of exterior framing 3 varies during the normal course of construction. This variation in the on-center distance can be significant relative to the narrow width of studs 4 and the need to make solid connections between structure connection system 10 and exterior framing 3. In contrast, the present disclosure employs fasteners 30 to connect batten plates 20 to the approximately three (3) to six (6) inch width of backing plates 12. Further, backing plates 12 are positioned in an approximately horizontal alignment and vertically spaced at a standardized distance such as approximately sixteen (16) or approximately twenty-four (24) inches on center accommodate a much more rapid construction with greater structural integrity.

Continuing with the preferred embodiment, drainage mat 22 and grid panels 24 of the second section are preferably initially connected to the first section by adhesive. A plurality of second fasteners 34 connects grid panels 24 and drainage mat 22 to the first leg 20*a* of batten plates 20. Second fasteners 34 are preferably screwed through existing apertures in grid panels 24 and have a metal cutting tip that is suitable to cut through drainage mat 22 and batten plates 20. This structural arrangement aids in the speed of assembly of the second section to the first section of structure connection system 10 by creating larger target areas for first section fasteners 30 to backing plate 12 and second section second fasteners 34 to batten plate 20. In addition, the separate layers add flexibility and efficiency when they are required to be cut and/or bent to accommodate building structural variations such as window and door openings as well as corners. The head and shaft of second fasteners 34 can further include an insulative coating, sleeves, inserts and/or washers to lessen the thermal conductivity of second fasteners 34.

Batten plate 20 second leg 20*b* is preferably inserted into insulation 18. Second leg 20*b* is preferably fully inserted into insulation 18 such that the inwardly directed side of first leg 20*a* directly abuts insulation 18. In addition, insulation 18 can include a channel slot that receives and positions first leg 20*a* approximately flush with the external surface of insulation 18. The depth of the channel slot can further include the head of fasteners 30 that are inserted into insulation 18 to define an approximately flush outwardly facing surface with insulation 18 for the application of drainage mat 22 and grid panels 24 as a plane. It is understood that most drainage mats 22 configurations have sufficient thickness and structure to flexibly accommodate first leg 20*a* positioned on the outer surface of insulation 18 without being indented therein and still retain a planar configuration for grid panels 24. It is critical for the long term reliability and weather protection that the external façade be constructed to define as true of a flat plane as practical without waves or any form of undulations.

Figure 2:
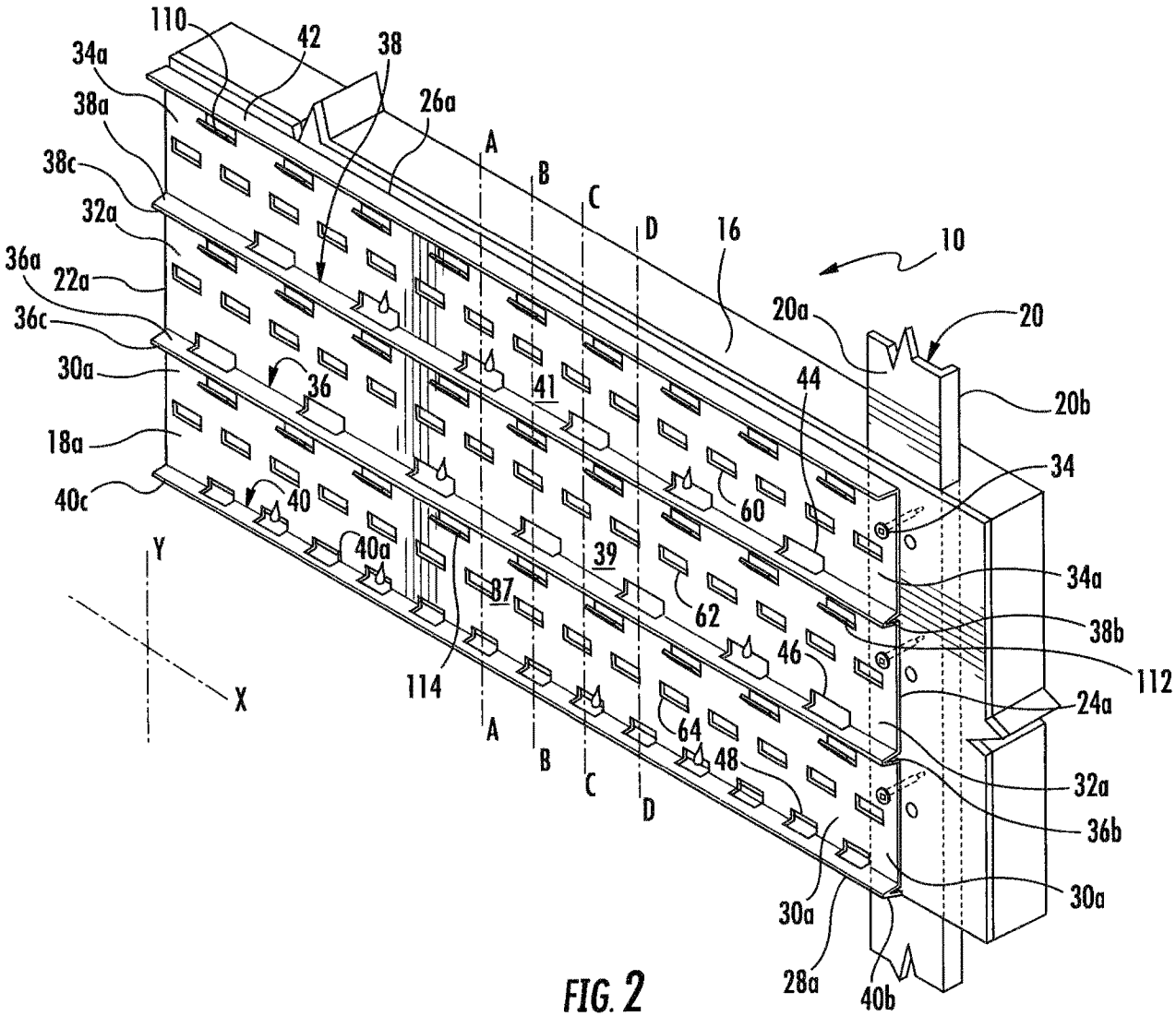
FIG. 2 is a front, top and side close-up perspective view of the structure connection system of FIG. 1 that shows the drainage of fluids through a grid panel of the external façade.

Referring now to FIGS. 1 and 2, grid panel 24 has a rectangular shape with a front face 18*a* and an opposed rear face (not shown). The grid panel 24 rectangular shape includes a first lateral side edge 22*a*, an opposed second lateral side edge 24*a*, an upper longitudinal side edge 26*a* and a lower third longitudinal side edge 28*a*. Longitudinal side edges 26*a* and 28*a* have a greater length than lateral side edges 22*a* and 24*a*.

The front faces 18*a* of grid panels 24 define partitions 36, 38, 40 and 42 that are cantilever beams that extend between lateral edges 22*a* and 22*b* and outwardly from front 18*a*. Partitions 36, 38, 40 and 42 define three (3) approximately U-shaped channels 30*a*, 32*a* and 34*a*, respectively there between that receive thin bricks 26. The opening for each channel 30*a*, 32*a* and 34*a* is directed outward from and is approximately perpendicular to front face 18*a*.

Grid panel 24 upper edge 26*a* and lower edge 28*a* as well as partitions 36, 38, 40 and 42 are aligned with a longitudinal axis-X. Grid panel 24 lateral edges 22*a* and 24*a* are aligned with axis-Y that is perpendicular to longitudinal axis-X. It is understood that as described herein the axis-Y is a vertical axis and axis-X is a horizontal axis. Axes X and Y define a plane that is aligned with grid panel 24. It is also understood that the terms up, upward or the upward direction is defined as approximately vertical movement in the direction from lower edge 28*a* towards upper edge 26*a*. The terms down, downward or the downward direction is defined as approximately vertical movement in the direction from upper edge 26*a* towards lower edge 28*a*. The terms inward, inward direction or inwardly are defined as approximately in the direction perpendicular to grid panel back 20*a* and towards exterior framing 3. Similarly, the terms outward, outward direction and outwardly are defined as approximately in the direction perpendicular to grid panel front 18*a* and out or away from exterior framing 3. It is understood that grid panels are typically installed along a level horizontal line, but that grid panels 24 can be installed at an acute angle from the horizontal.

Channel 30*a* is defined by partition 40, partition 36 and wall 37. Channel 32*a* is defined by partition 36, partition 38 and wall 39. Channel 34*a* is defined by partition 38, partition 42 and wall 41. Walls 37, 39 and 41 are approximately aligned with front 18*a* and plane X-Y. In this one preferred embodiment, partitions 36*a* and 38*a* are positioned equidistantly between partition 40*a* and partition 42*a*. Partition 40*a* includes lower edge 28*a* and partition 42*a* includes upper edge 28*a*.

Partition 38 is preferably a V-shaped fold in sheet 24 that protrudes outwardly from front 18*a*. Partition 38 includes an upward facing first portion 38*a* and a downward facing second portion 38*b* joined at a fold or an edge 38*c*. Portion 38*a* defines a ledge that preferably inclines downward from wall 41 to edge 38*c*. The angle of inclination of portion 38*a* from the perpendicular to wall 41 can vary and/or be arcuate, but preferably defines a slope from the horizontal for the downward flow of water. Portion 38*b* is inclined downward from edge 38*c* to wall 39. The angle of inclination of portion 38*b* from the perpendicular to wall 39 can vary and/or be arcuate, but defines a slope from the horizontal for the downward flow of water to back 20*a*. The gap between portions 38*a* and 38*b* preferably increases from edge 38*c* to front 18*a* to define the approximate V-shape of partition 38.

Upwardly facing portion 38*a* is a support structure for the thin bricks and includes at least one drainage aperture 44 that is a through hole in grid panel 24. At least one aperture 44 is preferably a plurality of apertures 44 that is arranged in a fixed spaced separation along portion 38*a*. In this one preferred embodiment, the arrangement of the plurality of apertures 44 is approximately aligned with partition 38 and the longitudinal axis-X. As shown by exemplary axes A and C, the location of each aperture 44 defines a vertical axis aligned with axis-Y. In this preferred embodiment, at least a portion of each aperture 44 extends from portion 38*a* onto wall 41 of channel 34. Each aperture 44 has a downwardly directed angle of orientation that is an acute offset from the vertical axis and directed inwardly.

Individual apertures 44 are preferably defined by rectangular shaped rims with an approximately three-quarter (¾) inch longitudinal length and approximately one-quarter (¼) inch lateral length. Apertures 44 are preferably spaced at approximately one and one-quarter (1¼) inch intervals between lateral edges. As described above, the rims of apertures 44 on portion 38*a* preferably extend across and onto the adjoining wall 41. The lower second portion 38*b* of the V-shaped partition 38 is a solid wall that is impermeable to fluids. Apertures 44 defined in upward facing portion 38*a* are vertically aligned with solid wall downwardly facing portion 38*b*.

Partition 36 preferably has the same V-shaped folded structure as partition 38 with an upward facing first portion 36*a* and a downward facing second portion 36*b* joined at a fold or an edge 36*c*. Portion 36*a* defines a ledge that inclines from wall 39 to edge 36*c*. The angle of inclination of portion 36*a* from the perpendicular to wall 39 can vary and/or be arcuate, but preferably defines a slope from the horizontal for the downward flow of water. Portion 36*b* is inclined downward from edge 36*c* to wall 37. The angle of inclination of portion 36*b* from the perpendicular to wall 37 can vary and/or be arcuate, but defines a slope from the horizontal for the downward flow of water. The gap between portions 36*a* and 36*b* preferably increases from edge 36*c* to front 18 to define the approximate V-shape of partition 36.

Upwardly facing portion 36*a* is a support structure for thin brick and includes at least one drainage aperture 46 that is a through hole in grid panel 24. At least one aperture 46 is preferably a plurality of apertures 46 that is arranged in a preset fixed spaced separation along portion 36*a*. In this one preferred embodiment, the arrangement of the plurality of apertures 46 is approximately aligned with partition 36 and the longitudinal axis-X. As shown by exemplary axes B and D, the location of each aperture 46 defines a vertical axis aligned with axis-Y. In this preferred embodiment, at least a portion of each aperture 46 extends from portion 36*a* onto wall 39 of channel 32. Each aperture 46 has a downwardly directed angle of orientation that is an acute offset from the vertical axis and directed inwardly.

Individual apertures 46 are preferably defined by rectangular shaped rims with an approximately three-quarter (¾) inch longitudinal length and approximately one-quarter (¼) inch lateral length. Apertures 46 are preferably spaced at approximately one and one-quarter (1¼) inch intervals between lateral edges. As described above, the rims of apertures 46 on portion 36*a* preferably extend across and onto the adjoining wall 39. The lower second portion 36*b* of the V-shaped partition 36 is a solid wall that is impermeable to fluids. Apertures 46 defined in upward facing portion 36*a* are vertically aligned with solid wall downwardly facing portion 36*b*.

Partition 40 preferably has the same V-shaped folded structure as that of partitions 36 and 38. Partition 40 includes an upward facing first portion 40*a* and a downward facing second portion 40*b* joined at a fold or an edge 40*c*. Portion 40*a* defines a ledge that inclines from wall 37 to edge 40*c*. The angle of inclination of portion 40*a* from the perpendicular to wall 37 can vary and/or be arcuate, but preferably defines a slope from the horizontal for the downward flow of water. Portion 40*b* is inclined downward from edge 40*c* to a terminal free end or lower edge 28 of grid panel 24. The angle of inclination of portion 40*b* from the perpendicular can vary and/or be arcuate, but claims a slope from the horizontal for the downward flow of water. The gap between portions 40*a* and 40*b* preferably increases from edge 40*c* to front 18 to define the approximate V-shape of partition 40.

Upwardly facing portion 40*a* is a support structure for the thin bricks and includes at least one drainage aperture 48 that is a through hole in grid panel 24. At least one aperture 48 is preferably a plurality of apertures 48 that is arranged in a fixed spaced separation along portion 40*a*. In this one preferred embodiment, the arrangement of the plurality of apertures 48 is approximately aligned with partition 40 and the longitudinal axis-X. As shown by exemplary axes A through D, the location of each aperture 48 defines a vertical axis aligned with axis-Y. In this preferred embodiment, at least a portion of each aperture 48 extends from portion 40*a* onto wall 37 of channel 30*a*. Each aperture 48 has a downwardly directed angle of orientation that is an acute offset from the vertical axis and directed inwardly.

Individual apertures 48 are preferably defined by rectangular shaped rims with an approximately one-half (½) inch longitudinal length and approximately one-quarter (¼) inch lateral side length. Apertures 48 are preferably spaced at approximately one-half (½) inch intervals between lateral edges. As described above, the rims of apertures 48 on portion 40*a* preferably extend across and onto the adjoining wall 37. The lower second portion 40*b* of the V-shaped partition 40 is a solid wall that is impermeable to fluids. Apertures 48 defined in upward facing portion 40*a* are vertically aligned with solid wall downwardly facing portion 40*b*.

Partition 42 is located along upper side edge 26*a* and is preferably includes a single fold with a free end that extends at an acute angle upwardly. Partition 42 is configured to interface with the partition 40 located along lower longitudinal side edge 28*a* such that an array of grid panels 24 can be connected. Partition 42 can also have the same or alternative variation of the V-shaped folded structure as partitions 36, 38 and 40 and retain the same interface with partition 40.

Figure 3:
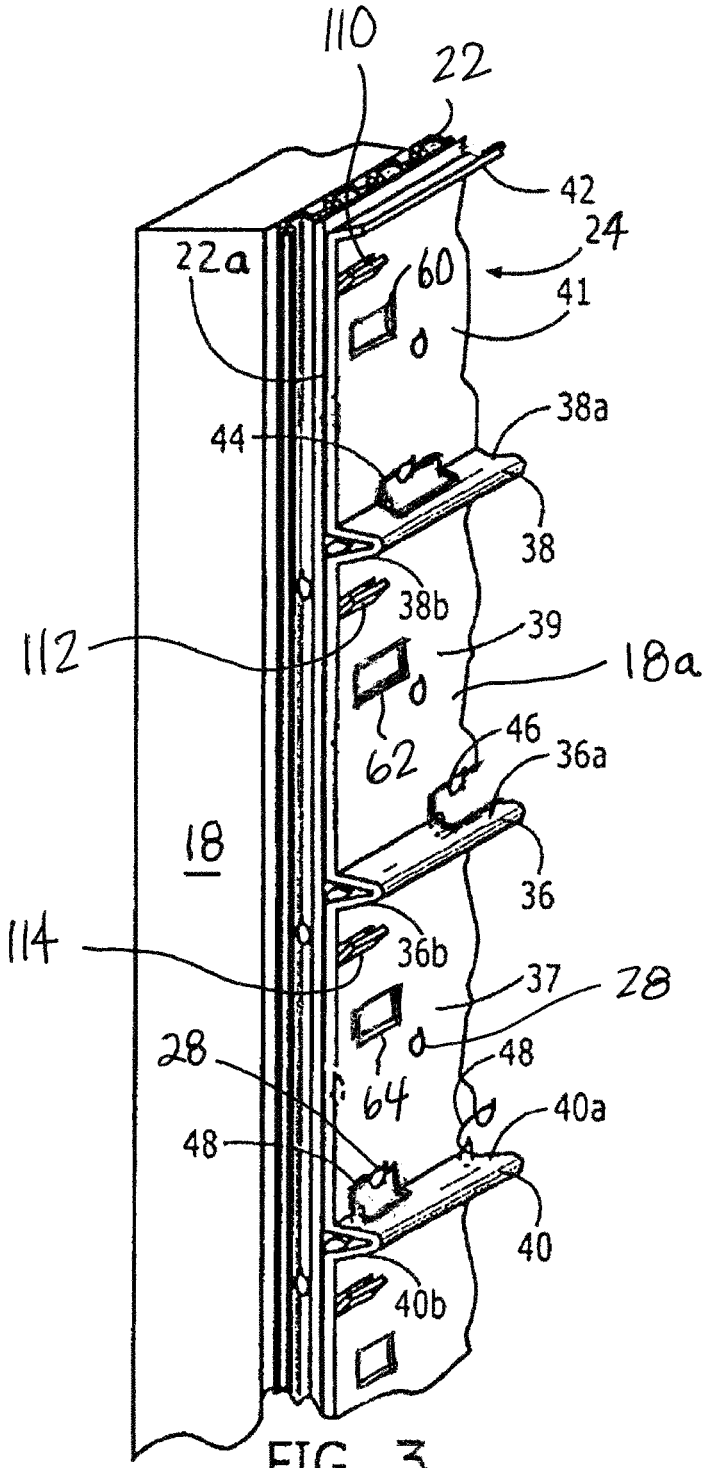
FIG. 3 is a partial front, top and side close-up perspective view of the structure connection system of FIG. 1 that shows an alternative arrangement of the apertures of the grid panel for fluid flow.

As shown in FIGS. 1-3, apertures 44, 46 and 48 are arranged to collect water on grid panel 24. In addition, apertures 44, 46 and 48 provide aeration for grid panel 24. In this preferred embodiment, apertures 44 are aligned with vertical axes A and C and apertures 46 are aligned with vertical axes B and D. The respective vertical centerlines of apertures 46 are offset from the vertical centerlines of apertures 44 and not aligned relative to the axis-X. The centerlines of apertures 46 are positioned approximately at the midpoint between the two-inch intervals between the centerlines of apertures 44. Apertures 48 can be aligned with axes A, B, C and D or offset therefrom. The arrangement of apertures 44, 46 and 48 ensures a systematic and substantially continuous collection of water along partitions 38, 36 and 40 of front 18 and the passage of that water through and to the of back grid panel 24. The vertical alignments and elongate rectangular shape of the at least one aperture 44, 46 and 48 of partitions 38, 36 and 40, respectively, ensure the systematic collection of water by grid panel 24.

Apertures 44, 46 and 48 are described herein as having rectangular rims and being linearly aligned at fixed intervals along partitions 36, 38 and 40. It is understood, however, that the rims of apertures 44, 46 and 48 can take any shape, such as for example circular, polygons or slots that extend onto at least part of portions 36*a*, 38*a* and 40*a* and remain within the scope of the present disclosure. Similarly, the arrangement of apertures 44, 46 and 48 can vary in their intervals and alignments and remain within the scope of this disclosure. Apertures 44, 46 and 48 are configured and located to enhance the transfer of moisture from front face 18*a* through apertures 44, 46 and 48 onto their respective partitions 38*b*, 36*b* and 40*b* and down rear face 22*a* of grid panels 24. In the preferred embodiment, apertures 44, 46 and 48 are punched through grid panel 24 from front face 18*a* towards rear face 20*a*. This important manufacturing difference leaves an inwardly directed taper around the perimeter of each aperture that facilitates the flow of moisture into apertures 44, 46 and 48 and onto the back of grid panel 24 and/or into drainage mat 22. This construction in combination with the straight sided rectangular shape of apertures 44, 46 and 48 further facilitates the passages of moisture or water through apertures 44, 46 and 48 and downward onto the back of grid panel 24.

Partition 42 can have the same approximate structure as that of partitions 36, 38 and 40 or alternatively have a structure that is a simple cantilevered beam that bounds the upper side of channel 34. The cantilevered beam of partition 42 has an upward facing side 42*a* and a downward facing side 42*b* and preferably inclines upward from wall 41 to upper edge 26 of grid panel 24. Partition 42 is preferably a liquid impermeable partition, but partition 42 can also include one or more apertures. The angle of inclination of partition 42 from the perpendicular to wall 41 can vary and/or be arcuate, but preferably defines a slope from the horizontal for the downward flow of water. Partition 42 or first connector 42 also preferably functions to connect with other sheets 12.

The distance between partitions 36, 38, 40 and 42 can vary depending upon the intended application of grid panel 24. For example, standard distances between partitions can include 2¾, 2½, 2¾, 3⅝ and 7⅝ inches. It is understood, however that the distance between partitions can be varied for any desired application to include variations from the above-identified standard distances and can further include variations in the distance between partitions to facilitate dimensional design variations in thin brick styles such as stone or simulated stone applications.

Sheets 12 are connected together in an arrangement by positioning partition 42 in the gap between portions 40*a* and 40*b* of partition 40 of another grid panel 24. Similarly, partition 40 receives a partition 42 from another grid panel 24 such that sheets 12 can connect across a drainage panel 14 and/or support structure 16 of a wall.

Grid panel 24 also includes a plurality of apertures or through holes 60 in channel 34*a*, 62 in channel 32*a* and 64 in channel 30*a*. Apertures 60, 62 and 64 are preferably defined by rectangular rims with the elongate axis aligned with axis-X. In one preferred embodiment apertures 60, 62 and 64 are covered with double-faced tape or used in conjunction with adhesive to temporarily connect the thin bricks 26 positioned on each ledge or partition 36*a*, 38*a* and 40*a* during the laying of thin bricks 26. The tape and/or adhesive temporarily lock thin bricks 26 in place on grid panel 24. Joint mortar is applied around the thin bricks 26 to permanently attach the thin bricks 26 the grid panel 24. Mortar tie apertures 110, 112 and 114 are preferably formed as partial punches in walls 41, 39 and 37 respectively and assist in the strength of the connection between the mortar, thin bricks 26 and grid panel 24. Mortar tie apertures 110, 112 and 114 are preferably positioned at approximately two and one-half (2½) to three (3) inch intervals to facilitate the anchoring of the joint mortar and thin brick or tile in position in channels 34*a*, 32*a* and 30*a*.

The height and length dimensions of grid panels 24 can vary depending upon the intended application of structure connection system 10. Factors include the dimensions of drainage mat 22, size of thin bricks 26 and the exterior framing. In one preferred embodiment grid panels or sheets 24 range in dimensions from approximately eight (8) to twelves (12) inches in height and from forty-eight (48) to ninety-six (96) inches in length. It is understood that sheets of grid panels 24 can be fabricated in any dimensions to meet any particular construction need to include larger dimensions of 10 feet by 12 feet, for example. Sheets 12 are preferably made of corrosion resistant sheet metal, but sheets 12 can also be fabricated of other materials such as polymers or composites.

Figure 4:
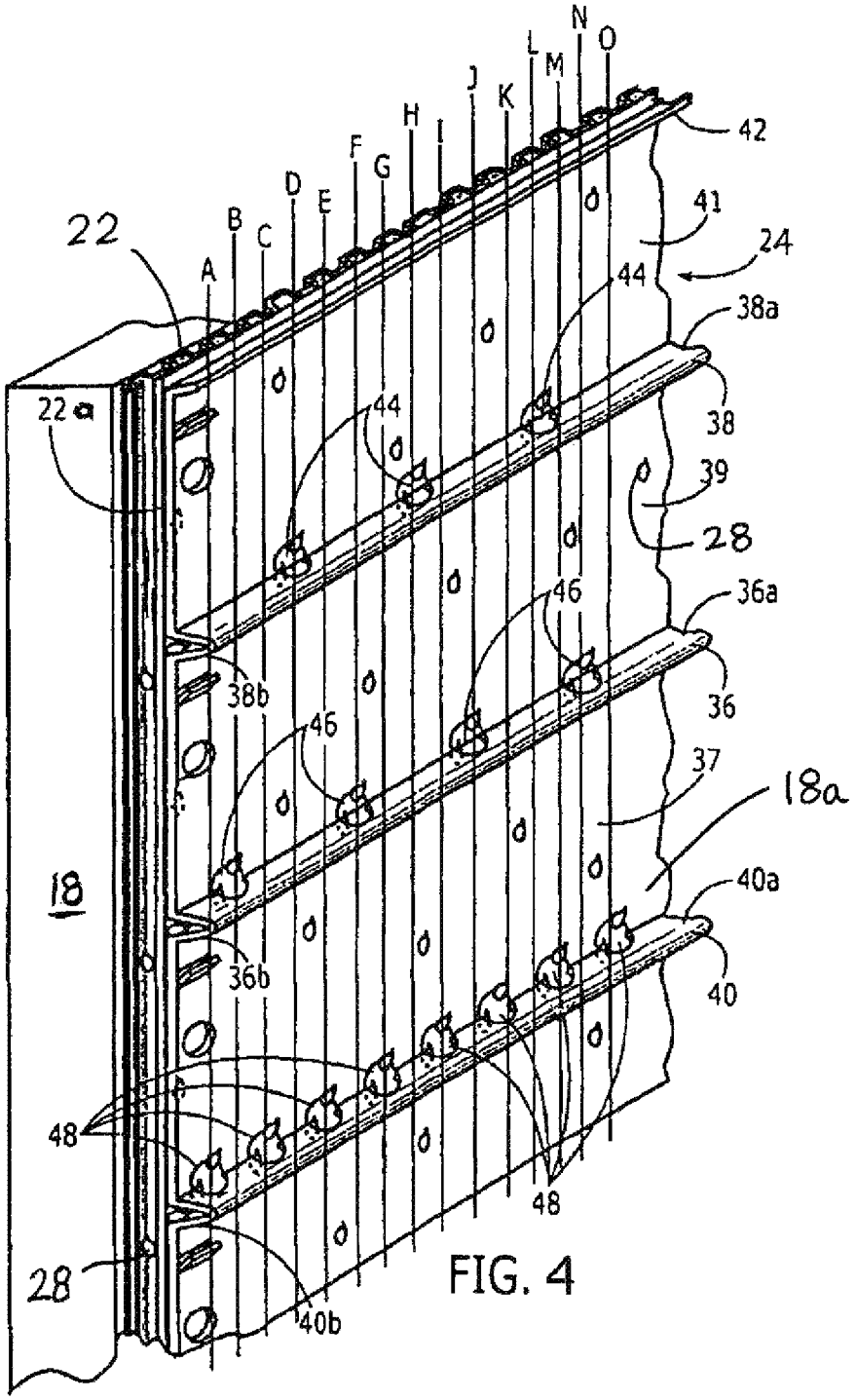
FIG. 4 is a partial front, top and side close-up perspective view of the structure connection system of FIG. 3 that shows the alternative arrangement of the apertures of the grid panel.

Referring now to FIGS. 3 and 4, thin brick and tile drainage system 10 in a second preferred arrangement of apertures 44, 46 and 48 can include a separate alignment for each aperture 44, 46 and 48 as shown in vertical axes A through O. In addition, while apertures 44, 46 and 48 are preferably defined by rectangular rims, apertures 44, 46 and 48 can have arcuate shaped rims such as those in FIG. 4 as previously described in detail in U.S. Pat. No. 8,141,310 Thin Brick and Tile Drainage System and is incorporated herein by reference. It is understood that apertures 44, 46 and 48 can have any arrangement, spacing or shape of rim. Apertures 60, 62 and 64 facilitate the connection of thin bricks 26 to grid panel 24 prior to the application of the mortar that permanently connects thin bricks 26 to grid panel 24. Mortar tie apertures 110, 112 and 114 are preferably a three sided cut with an upwardly and inwardly directed opening that receives a portion of the mortar.

As shown in FIGS. 1-4, the flow of fluids is represented by and described herein through the idealized representation of the drops 28 of water depicted on grid panel 24 and/or drainage mat 22 Grid panel 24 apertures 44, 46 and 48 as described previously are preferably rectangular shaped and positioned at least partially on vertical walls 41, 39 and 37 and the upward facing sloped partitions 38*a*, 40*a* and 36*a*, respectively. Apertures 44, 46 and 48 collect and pass fluids from front face 18*a* to the back side of the downward facing sloped solid partitions 38*b*, 40*b* and 36*b* of grid panel 24. The drops 28 collected through apertures 44, 46 and 48 drain downwardly on the back side of grid panel 24 and/or through drainage mat 22.

Figure 5:
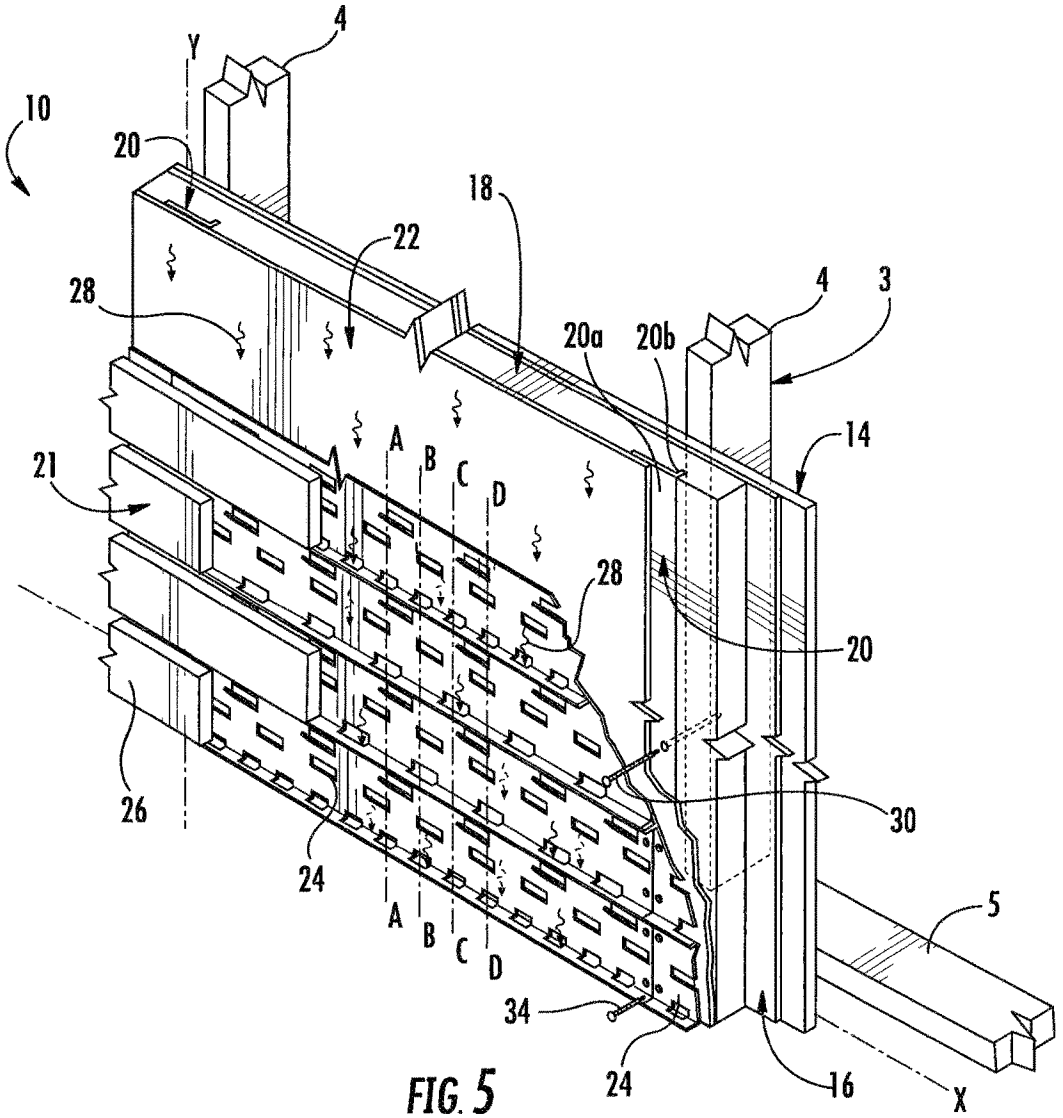
FIG. 5 is a front, side and top perspective view of an alternative configuration of the structure connection system of FIG. 1.

Referring now to FIG. 5, backing plates 12 are an optional element of structure connection system 10 and are omitted from this configuration. Even though the actual on-center spacing of studs 4 of exterior framing 3 varies, builders may not desire to use backing plates 12. In this configuration, the first section exterior sheathing 14 connects directly to exterior framing 3 and is followed by the previously described moisture resistant barrier 16, insulation 18 and batten plates 20. Batten plates 20 are aligned with the studs 4 of exterior framing 3 and are connected by screws 30 through the first section to exterior framing 3. This configuration provides a simplified alternative first section that omits the additional step in the construction and expense of the materials for backing plate 12. It is recognized, however, that the combination of backing plate 12 and batten plate 20 provide a reliable secure connection for external façade 21.

Figure 6:
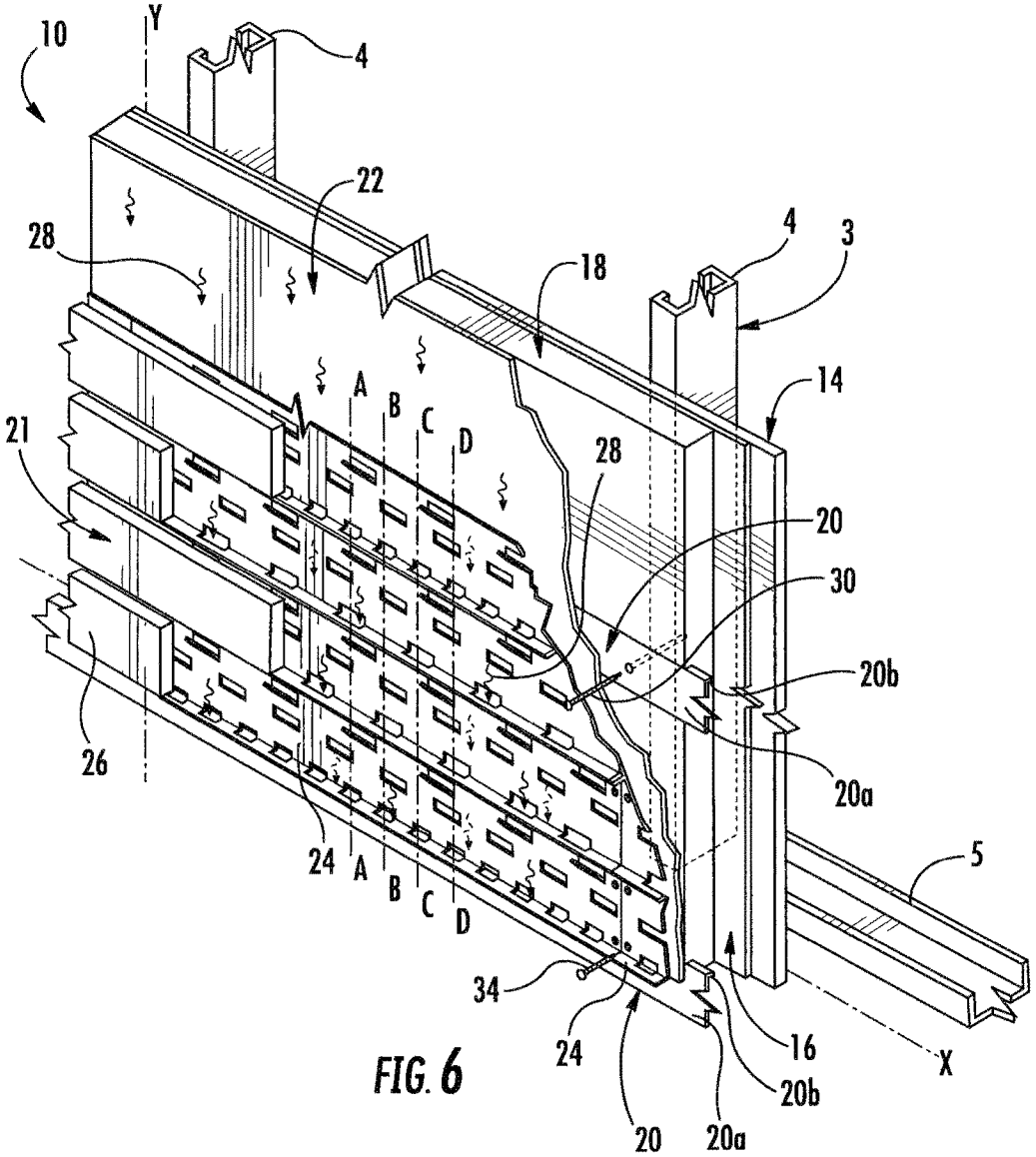
FIG. 6 is a front, side and top perspective view of an alternative configuration of the structure connection system of FIG. 5.

As shown in FIG. 6, structure connection system 10 is shown again without backing plates 12 and another alternative arrangement with batten plates 20 positioned approximately horizontally. Batten plates 20 are preferably positioned in fixed spaced on-center with standard twelve (12), sixteen (16) or twenty-four (24) inch spacing. As shown, second leg 20*b* is inserted into insulation 18 such that first leg 20*a* extends downward approximately flush with the surface of insulation 18. This arrangement, with or without backing plates 12, provides a secure connection of the first section to exterior framing 3 and can readily accommodate installations that include both the horizontal and vertical alignment of the elongate edge of four by eight (4×8) rigid foam board insulation 18.

Figure 7:
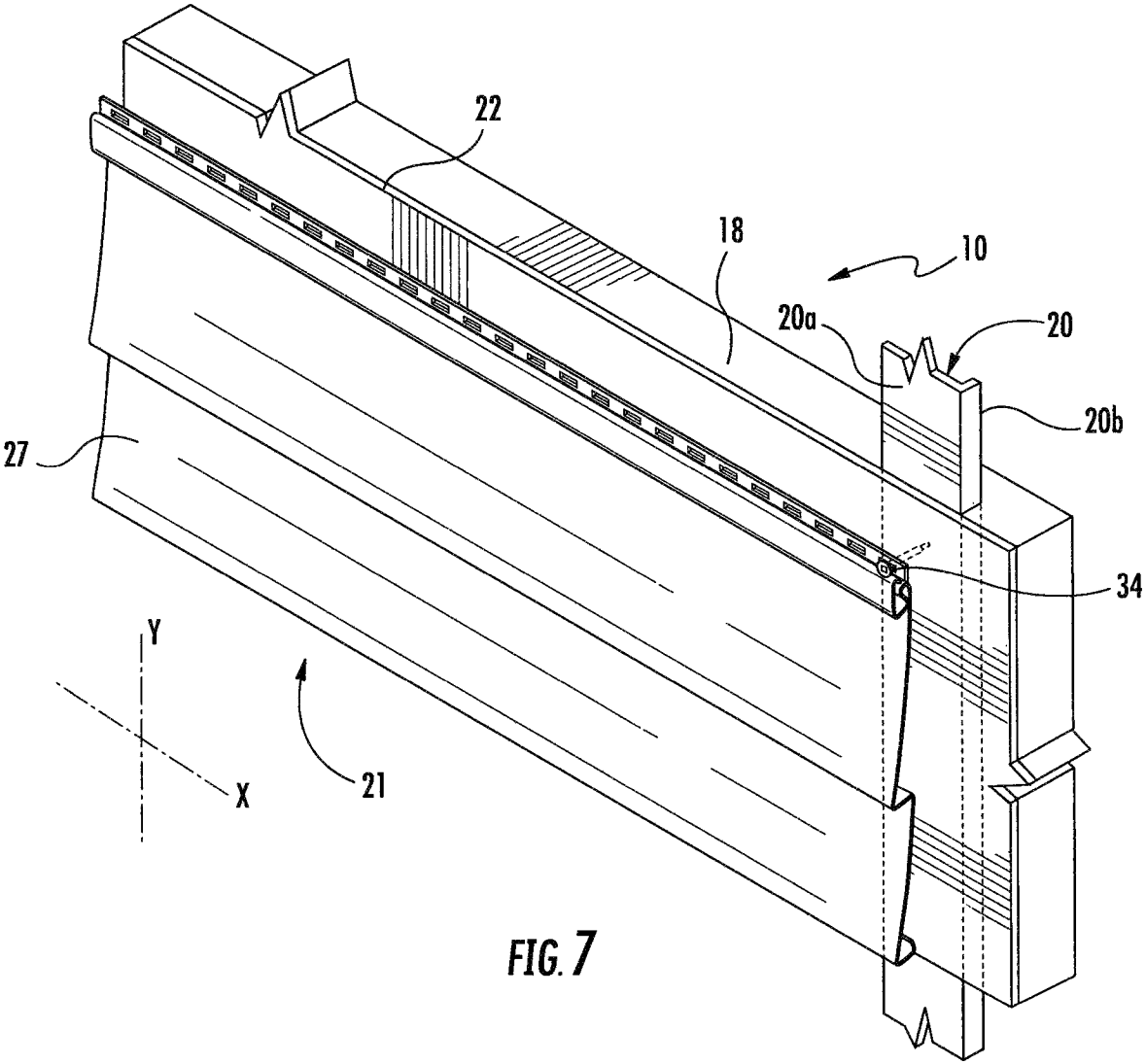
FIG. 7 is a front, side and top perspective view of an alternative configuration of the structure connection system of FIG. 1 that includes siding as the external façade.

Referring now to FIG. 7, structure connection system 10 can also be used with alternative external facades 21 to grid panels 24 and thin bricks 26. Alternative external facades 21 can include any external weatherproof protection system to include siding, shingles, panels and stucco. Thermal resistant drainage mat 22 can be included in this second section or omitted.

Batten plates 20 are connected to exterior framing 3 as described previously (See FIGS. 1, 5 and 6), to include batten plates 20 positioned horizontally or vertically as we as with or without backing plates 12 as described previously. This includes batten plates 20 aligned with studs 4 without backing plate 12 and batten plates 20 with backing plates 12 that are aligned or not aligned with studs 4.

The external façade, such as horizontal siding, is connected to batten plates 20 using fasteners 34 as described previously. The spacing between batten plates 20 can be driven by many different factors to include the type of external façade 21.

As shown in FIGS. 1-7, the first section of structure connection system 10 is preferably assembled as a series of layers that include optional backing plate 12, exterior sheathing 14, moisture resistant barrier 16, insulation 18 and batten plates 20, but it is understood that the first section can as an option be at least partially preassembled. The advantages to construction in separate layers on site include the ability to more readily adapt to variances in the exterior structure that include the position of doors, windows, etc. which frequently are not exactly positioned as planned. These variances in the construction create problems when the preassembled layers have to be cut and fitted rather than cutting and fitting individual layers.

Fasteners 30 connect the first section into an integrated assembly against backing plates 12 and/or the exterior framing 3 of the external structure. The threads of fasteners 30 assist in the placing of the layers of the first section in compression between the plurality of batten plates 20 and backing plate 12 and/or exterior framing 3. The rigidity of the first section is such that the connection provided by fasteners 30 supports the first section as a cantilevered assembly connected to exterior framing 3. The connection between fasteners 30 into and through the apertures 32 of batten plates 20 include inserts 33 that provide a thermal break.

The second section connects to the plurality of batten plates 20 and is supported by the connection of the first section to the exterior framing 3. Second fasteners 34 connect the external façade and drainage mat 22, when present, to batten plates 20. In the preferred embodiment, the second section includes grid panels 24 and fasteners 34 extend through grid panels 24 and drainage mat 22 to securely connect the grid panels 24 to the exterior framing 3 as an extension to the existing cantilevered first section.

Grid panels 24 provide a unique fluid flow system that provides enhanced fluid flow behind grid panels 24 for the dissipation of fluids from on or behind grid panels 24. When grid panel 24 comes in contact with a fluid such as water for example that can be in the form of vapor, moisture penetration, water intrusion or condensation, the water is provided defined avenues of direction downward from grid panel 24 as shown by exemplary axes A, B, C and D as shown in FIG. 2. The flat surfaces of walls 37, 39 and 41, the slope of surfaces 36, 38, 40 and 42 and apertures 44, 46 and 48 cooperatively assist in the drainage of water from front 18*a* to back 20*a*. The angled and perforated structure of grid panel 24 denies water the opportunity to pool or accumulate. In addition, water can also be provided additional avenues downward through and/or on drainage mat 22. Grid Panel 24 alone or in conjunction with drainage mat 22 directs water from front to back and downward for the controlled drainage of the overall structure. As an example, the downward traveling water on wall 41 passes onto portion 38*a* and, if so aligned for example, passes into aperture 44. The water then travels downward onto the adjoining at least liquid impermeable wall portion 38*b* and down the inclined back of portion 38*b* to back 20 of grid panel 24. Once the water is in on back 20*a* of grid panel 24 it continues downwards due to gravity for collection and drainage. Alternatively, the downward movement of the water as a liquid and/or in the form of a fluid can also include travel along or through drainage mat 22. The spacing of apertures 44, 46 and 48 on partitions 38, 36 and 40, respectively, increases the ability of grid panel 24 to collect water on front 18*a* and redirect that water to the back of grid panel 24.

The water that drains down front 18*a* of grid panel 24 that is not collected by aperture 44, for example, passes down to wall 39 and/or partition 36 and through apertures 46 and is redirected by portion 36*b* to the back side of grid panel 24. Alternatively, draining water that is missed by apertures 44 and 46 is received into and redirected by the increased number of apertures 48 on partition 40. When grid panel 24 is connected with other grid panels 24 and partition 42 is positioned between portions 40*a* and 40*b*, partition 42 can be positioned and inclined to provide a redirection of drainage or liquid to back 20. It is the intended function of apertures 44, 46 and 48 to redirect the water or other liquid from front 18*a* of grid panel 24 to back 20*a* and/or drainage mat 22 when present.

Grid panels 24 are specifically constructed to remove potential barriers for the downward travel of water and eliminate areas that can accumulate water due to the angle of partitions 36, 38, 40 and 42 and walls 37, 39 and 41. For example, grid panel 24 apertures 44, 46 and 48 are preferably punched in the manufacturing process from the front 18*a* to the back of grid panel 24. The punching process creates a lip on the opposing back side from the punch. The front to back punch direction provides for smooth uninterrupted fluid flow from the front 18*a* of the grid panel 24 to the back side. In contrast, the standard industry process punches from the rear to the front and creates an undesirable lip that redirects fluid flow around the apertures. The arrangement of apertures 44, 46 and 48 advantageously redirects water from diverse paths of fluid flow on front 18*a* through apertures 44, 46 and 48 to the back side of grid panel 24. In addition, the preferably angular shaped rims of apertures 44, 46 and 48 of grid panels 24 aid in the drainage of water through grid panels 24 over arcuate shaped apertures. The water from grid panels 24 is collected and drained at the base of the structure. Further, grid panel 24 has a structure that reduces the likelihood of the undesirable growth of mold and mildew through the use of sloped surfaces that preclude the pooling of liquids and apertures that advantageously provide a plurality of paths for air to circulate through grid panel 24.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. In addition, though the present invention is described in terms of a series of embodiments, each embodiment of the present invention can combine one or more novel features of the other embodiments. The specification and drawings are accordingly to be regarded in an illustrative manner rather than a restrictive sense.

What is claimed is:

1. A structure connection system for connecting an exterior façade to an exterior framing of a structure, the structure connection system comprises:

a first section, the first section includes an exterior sheathing, an insulation sheathing and a plurality of batten plates, the exterior sheathing adapted to connect to an exterior framing, the insulation sheathing a thermal rigid insulation board sheathing, the insulation sheathing has approximately planar front and back surfaces and defines a depth between the front and back surfaces;

each batten plate of the plurality of batten plates is a right angle elongate plate, the right angle has a first elongate leg and a second elongate leg, the batten plate connection of the first elongate leg and the second elongate leg defines an elongate axis, the first leg has a first width normal to the elongate axis defined by the batten plate and the second leg, the second leg has a second width normal to the elongate axis defined by the batten plate and the first leg, the width of the first leg is equal to or greater than the width of the second leg, the second leg inserted into the front of the insulation sheathing and the first leg positioned against the front planar surface of the insulation sheathing, the width of the second leg extends between the elongate axis and an elongate edge of the second leg, the width of the second leg is less than the depth of the insulation sheathing, each batten plate of the plurality of batten plates located in fixed spaced separation from the adjacent batten plate;

a plurality of first fasteners, the first fasteners connect the first section into an integrated assembly, the first fasteners connect to the batten plates and the plurality of first fasteners adapted to connect the first section to the exterior framing, the first fasteners place the first section under compression; and an external façade and a plurality of second fasteners, the plurality of second fasteners connect the external façade to the plurality of batten plates, the first section and second section a cantilever structure adapted to be connected to the exterior framing.

2. The structure connection system of claim 1, wherein the second leg of the batten plate is a flat elongate plate and the insertion of the second leg into the insulation sheathing includes a friction connection between the sides of the second leg of the batten plate and insulation sheathing.

3. The structure connection system of claim 1, wherein the first leg of the batten plate is a flat plate and the first leg adapted to be at least partially recessed into the insulation sheathing such that the first leg of the batten plate is approximately flush with a front planar surface of the insulation sheathing.

4. The structure connection system of claim 1 wherein the second section includes a drainage mat and the external facade, the drainage mat defines channels for the downward flow of fluids, the external façade includes a plurality of grid panels, the drainage mat and grid panels connected by second fasteners to the plurality of batten plates.

5. The structure connection system of claim 4, wherein the first section includes a moisture resistant barrier positioned between the exterior sheathing and the insulation.

6. The structure connection system of claim 1, wherein the first section further includes backing plates, the backing plates are flat elongate plates, the backing plates positioned in approximate alignment and adapted to connect to the exterior framing, first fasteners connect the batten plates, insulation sheathing and external sheathing to the backing plates, the fasteners place the insulation sheathing and external sheathing under compression between the plurality of batten plates and a plurality of backing plates, the fasteners adapted to place the insulation sheathing and external sheathing under compression between the plurality of batten plates and the exterior framing.

7. The structure connection system of claim 1 that further includes a grid panel, the grid panel has a front face and an opposed back, a first lateral side edge and an opposed second lateral side edge, a longitudinal top edge and a longitudinally bottom edge, the front defines a plurality of longitudinally aligned channels, the channels defined by a pair of approximately parallel longitudinally aligned partitions, the pair of partitions separated by a wall of the front face, the partitions project forward from the front face, the channel adapted to receive and support thin bricks, a first partition that defines an approximately V-shape, the first partition comprises an upward facing first portion that defines a first plurality of apertures, each aperture of the plurality of apertures defines a first alignment perpendicular to the longitudinal alignment of the partition, a second partition that defines an approximately V-shape, the second partition comprises an upward facing first portion that defines a second plurality of apertures, each aperture of the second plurality of apertures defines a second alignment perpendicular to the longitudinal alignment of the second partition that is offset from the first alignment, each plurality of apertures positioned and aligned to redirect liquid received on the front of the grid panel to the back of the grid panel.

8. The structure connection system of claim 7, wherein the external façade includes a plurality of thin bricks, the thin bricks positioned on and securely connected to the grid panels.

9. The structure connection system of claim 1, wherein the batten plates include a thermal break between the batten plate and a first fastener that connects the first section to at least one of the backing plates and exterior framing.

10. The structure connection system of claim 1, wherein the plurality of batten plates are positioned in a vertical alignment.

11. The structure connection system of claim 1, wherein the plurality of batten plates are positioned in a horizontal alignment.

12. A structure connection system for connecting an exterior façade to an exterior framing of a structure, the structure connection system comprises:

a first section, the first section includes exterior sheathing and insulation sheathing, the exterior sheathing has a front and a back, the back of the exterior sheathing adapted to connect to an exterior framing, the insulation sheathing a thermal rigid insulation board sheathing, the insulation sheathing has a front approximately planar surface that faces and a back approximately planar surface;

a plurality of batten plates, each batten plate a right angle plate with an elongate length, the right angle has a first elongate plate shaped leg and a second elongate plate shaped leg, the first leg has a first width normal to the elongate length of the batten plate and the second leg has a second width normal to the elongate length of the first leg of the batten plate, the width of the first leg equal to or longer than the width of the second elongate leg, the second leg defines a free elongate edge, the second leg inserted into the insulation sheathing, the width of the second leg is less than the depth between the front surface and the back surface of the insulation sheathing, the first leg positioned against the front approximately planar surface of the insulation sheathing, the first leg approximately flush the front surface of the insulation sheathing, each batten plate of the plurality of batten plates located in fixed spaced separation from the adjacent batten plate, each batten plate adapted to connect the insulation sheathing and external sheathing to the exterior framing;

a plurality of first fasteners, the plurality of first fasteners connect to the plurality of batten plates and adapted to connect the first section to the exterior framing, each batten plate first leg defines a plurality of apertures, each first fastener connects through an aperture of the plurality of apertures in the batten plate, the first fastener adapted to connect the batten plate to the exterior framing, the fasteners adapted to place the first section under compression between the batten plates and the exterior framing; and an external façade and a plurality of second fasteners, the plurality of second fasteners connect the external façade to the plurality of batten plates, the first section and second section a cantilever structure adapted to be connected to the exterior framing.

13. The structure connection system of claim 12, wherein the first section further includes a backing plate, the backing plate positioned horizontal, the first fasteners connect to the batten late and backing plate and adapted to connect the first section adapted to connect to the exterior framing.

14. The structure connection system of claim 12 wherein the external façade includes a drainage mat and a metal grid, the metal grid has a front face and an opposed back, a first lateral side edge and an opposed second lateral side edge, a longitudinal top edge and a longitudinally bottom edge, the front defines a plurality of longitudinally aligned channels, the channels defined by a pair of approximately parallel longitudinally aligned partitions, the pair of partitions separated by a wall of the front face, the partitions project forward from the front face, the channel adapted to receive and support thin bricks, a first partition that defines an approximately V-shape, the first partition comprises an upward facing first portion that defines a first plurality of apertures, each aperture of the plurality of apertures defines a first alignment perpendicular to the longitudinal alignment of the partition, a second partition that defines an approximately V-shape, the second partition comprises an upward facing first portion that defines a second plurality of apertures, each aperture of the second plurality of apertures defines a second alignment perpendicular to the longitudinal alignment of the second partition that is offset from the first alignment, each plurality of apertures positioned and aligned to redirect liquid received on the front of the grid panel to the back of the grid panel.

15. The structure connection system of claim 12, wherein the external façade includes a plurality of thin bricks, the thin bricks configured for positioning on a first portion of one of the partitions of the grid panel, the thin bricks securely connected to the grid panel.

16. The structure connection system of claim 12, wherein the batten plates define apertures that include an insert and receive the first fastener, the insert provide a thermal break between the batten plate and the first fastener.

17. The structure connection system of claim 12, wherein the plurality of batten plates are positioned in a vertical alignment.

18. The structure connection system of claim 12, wherein the plurality of batten plates are positioned in a horizontal alignment.

19. A structure connection system for connecting an exterior façade to an exterior framing of a structure, the structure connection system comprises:

a first section, the first section includes exterior sheathing and insulation sheathing, the exterior sheathing has a front and a back, the back of the exterior sheathing adapted to connect to an exterior framing, the insulation sheathing a thermal rigid insulation board sheathing, the insulation sheathing defines a plurality of slots, the slots positioned in fixed spaced separation and in alignment, the insulation sheathing has a front approximately planar surface that faces and a back approximately planar surface, a plurality of batten plates, each batten plate a right angle plate with an elongate length, the right angle has a first elongate plate shaped leg and a second elongate plate shaped leg, the first leg has a first width normal to the elongate length of the second leg of the batten plate and the second leg has a second width normal to the elongate length of the first leg of the batten plate, the width of the first leg equal to or longer than the width of the second elongate leg, the second leg inserted into the slot in the insulation sheathing, the width of the second leg less than the depth between the front surface and the back surface of the insulation sheathing, a free elongate edge of the second leg embedded in the insulation sheathing, the first leg positioned against the front planar surface of the insulation sheathing, the first leg approximately flush the front planar surface of the insulation sheathing, each batten plate of the plurality of batten plates located in fixed spaced separation from the adjacent batten plate, each batten plate connects the insulation sheathing and external sheathing to the exterior framing of the exterior framing;

a plurality of fasteners, the fasteners connect the batten plates to the first section, each batten plate first leg defines a plurality of apertures, each fastener connects to the batten plate through an aperture of the plurality of apertures, the fastener adapted to connect the batten plate to the exterior framing, the fasteners place the first section under compression between the batten plates and the exterior framing, the batten plate includes a thermal break between the batten plate and the connectors;

a second section that includes a drainage mat, grid panels and thin bricks, the drainage mat defines channels for the downward flow of fluids, the metal grid has a front face and an opposed back, a first lateral side edge and an opposed second lateral side edge, a longitudinal top edge and a longitudinally bottom edge, the front defines a plurality of longitudinally aligned channels, the channels defined by a pair of approximately parallel longitudinally aligned partitions, the pair of partitions separated by a wall of the front face, the partitions project forward from the front face, the channel adapted to receive and support thin bricks, a first partition that defines an approximately V-shape, the first partition comprises an upward facing first portion that defines a first plurality of apertures, each aperture of the plurality of apertures defines a first alignment perpendicular to the longitudinal alignment of the partition, a second defines a first alignment perpendicular to the longitudinal alignment of the partition, a second partition that defines an approximately V-shape, the second partition comprises an upward facing first portion that defines a second plurality of apertures, each aperture of the second plurality of apertures defines a second alignment perpendicular to the longitudinal alignment of the second partition that is offset from the first alignment, each plurality of apertures positioned and aligned to redirect liquid received on the front of the grid panel to the back of the grid panel;

a plurality of second fasteners, each second fastener connects the external façade and drainage mat to the plurality of batten plates, the first section and second section a cantilever structure adapted to be connected to the exterior framing, the metal grid receives the thin bricks, the thin bricks connected to the grid panels.

20. The structure connection system of claim 12, wherein the external façade includes a grid panel and the grid panel includes three channels that are adapted to receive thin bricks, a third longitudinally aligned partition that has an approximately V-shape that includes a third plurality of apertures, the third plurality of apertures greater in number than the first plurality of apertures and the third plurality of apertures greater in number than the second plurality of apertures, the third partition includes a first portion that connects to a second portion, the first portion defines the third plurality of apertures, the second portion inclines downward and is a liquid impermeable barrier, each of the plurality of apertures is a punched through hole from front to back.

* * * * *